US006621474B2

(12) United States Patent
Nagakubo et al.

(10) Patent No.: US 6,621,474 B2
(45) Date of Patent: Sep. 16, 2003

(54) PLASMA DISPLAY APPARATUS

(75) Inventors: Tetsuro Nagakubo, Nakakoma-gun (JP); Tetsuya Shigeta, Nakakoma-gun (JP); Hirofumi Honda, Nakakoma-gun (JP)

(73) Assignee: Pioneer Corporation, Tokyo (JP)

( * ) Notice: Subject to any disclaimer, the term of this patent is extended or adjusted under 35 U.S.C. 154(b) by 262 days.

(21) Appl. No.: 09/861,855

(22) Filed: May 22, 2001

(65) Prior Publication Data

US 2002/0063662 A1 May 30, 2002

(30) Foreign Application Priority Data

May 25, 2000 (JP) ..... 2000-154866

(51) Int. Cl.[7] ..... G09G 3/28

(52) U.S. Cl. ..... 345/60; 345/208; 345/63

(58) Field of Search ..... 345/60–70, 28–210; 315/169.3, 169.4

(56) References Cited

U.S. PATENT DOCUMENTS 5,621,439 A * 4/1997 Okada et al. ..... 345/211
6,417,824 B1 * 7/2002 Tokunaga et al. ..... 345/60
6,483,251 B2 * 11/2002 Setoguchi et al. ..... 315/169.4

* cited by examiner

*Primary Examiner*—Lun-Yi Lao
(74) *Attorney, Agent, or Firm*—Sughrue Mion, PLLC

(57) ABSTRACT

A plasma display apparatus is configured to display excellent tone by estimating the impedance of the plasma display panel based on picture element data corresponding to a video signal and by changing driving pulse width in accordance with such estimated impedance.

12 Claims, 12 Drawing Sheets

FIG. 7

| | LINE IMPEDANCE FOR PREDETERMINED IMPEDANCE | |
|---|---|---|
| | SF1 | SF2 |
| 1ST DISPLAY LINE | LOW | HIGH |
| 2ND DISPLAY LINE | HIGH | LOW |
| 3RD DISPLAY LINE | HIGH | HIGH |
| 4TH DISPLAY LINE | LOW | LOW |

PLASMA DISPLAY APPARATUS

BACKGOUND OF THE INVENTION

1. Field of the Invention

The present invention relates to a plasma display apparatus.

2. Description of the Related Background Art

Recently, with the increase in the screen size of display apparatuses, there is an increased demand for of thin shape display apparatuses. Various kinds of thin display devices have been put into practical use, among which much attention is being paid to AC (Alternating Current) type plasma display panels as one type of such thin display device.

FIG. 1 is a schematic diagram showing the configuration of a plasma display apparatus comprising such a plasma display panel and a driver to drive this display panel.

In FIG. 1, the plasma display panel PDP 10 comprises m column electrodes $D_1$–$D_m$ as data electrodes, and n row electrodes $X_1$–$X_n$ and n row electrodes $Y_1$–$Y_n$ which intersect each of the column electrodes. One pair of $X_1$ ($1 \leqq i \leqq n$) and $Y_i$ ($1 \leqq i \leqq n$) of the row electrodes $X_1$–$X_n$ and $Y_1$–$Y_n$ forms one display line of the PDP 10. The column electrodes D and the row electrodes X and Y are arranged to face each other through a discharge space filled with a discharge gas. A discharge cell corresponding to one picture element is formed at the intersection of each row electrode and each column electrode with the discharge space between them.

Each discharge cell emits light by the discharge effect, so each cell can have only two states, a "light emitting" state or a "non-light emitting" state. That is, each discharge cell exhibits only two gradation levels, minimum brightness (non-light emitting state) and maximum brightness (light emitting state).

Therefore, the driver 100 performs gradation drive by using the subfield method in order to display brightness of half tone corresponding to a video signal supplied to the PDP 10. In the subfield method, the input video signal is converted to, for example, 4-bit picture element data corresponding to each picture element. In this drive method, the display period of one field is formed with four subfields SF1–SF4 as shown in FIG. 2, each subfield corresponding to each bit digit of such picture element data. As indicated in FIG. 2, a light emitting frequency (or light emitting period) corresponding to the weight of the subfield is allocated to each subfield.

FIG. 3 shows various kinds of driving pulses to be supplied by the driver 100 to the row electrode pairs and the column electrodes of the PDP 10 in each subfield shown in FIG. 2, and such pulse supply timing.

During the simultaneous reset process Rc shown in FIG. 3, the driver 100 first supplies positive reset pulses $RP_X$ to the row electrodes $X_1$–$X_n$, and negative reset pulses $RP_Y$ to the row electrodes $Y_1$–$Y_n$. In response to the supply of these reset pulses $RP_X$ and $RP_Y$, all the discharge cells of the PDP 10 are reset and discharged and a predetermined wall charge is uniformly formed in each discharge cell. Immediately after that, the driver 100 supplies erasing pulses EP to all the row electrodes $X_1$–$X_n$ of the PDP 10 at the same time. Because of the supply of such erasing pulses EP, an erasing discharge is generated in all the discharge cells and the above-mentioned wall charge disappears. Thus, all the discharge cells in the PDP 10 are initialized to the "non-light emitting cell" state.

During the next picture element data write process Wc, the driver 100 first converts an input video signal into 4-bit picture element data of each picture element. Then, for example, in the subfield SF1, the driver 100 generates picture element data pulses having a voltage corresponding to the logical level of the first bit of the picture element data. Then, the driver 100 supplies such pulses to the column electrodes $D_1$–$D_m$ sequentially, one row at a time (picture element data pulse group $DP_1$–$DP_n$). For example, the driver 100 generates picture element data pulses of high voltage when the logical level of the first bit of the picture element data is "1", and generates picture element data pulses of low voltage (0 volt) when the logical level is "0". In addition, the driver 100 generates scanning pulses SP synchronized with the supply timing of each picture element data pulse group DP, then supplies such pulses to the row electrodes $Y_1$–$Y_n$ sequentially. In this case, a write discharge is selectively generated and a wall charge is formed only at a discharge cell at the intersection of a display line to which scanning pulses SP are supplied and a "column" to which high voltage picture element data pulses are supplied. Therefore, a discharge cell which has been initialized to the "non-light emitting cell" state during the simultaneous reset process Rc is set to the "light emitting cell" state. On the other hand, a discharge cell to which the scanning pulses SP were supplied and at the same time the low voltage picture element data pulses were also supplied does not generate a write discharge. Thus, this discharge cell is maintained at the state initialized during the simultaneous reset process Rc, namely, at the "non-light emitting cell" state.

During the next light emission maintaining process Ic, the driver 100 supplies maintaining pulses $IP_X$ and $IP_Y$ as shown in FIG. 3 to the row electrodes $X_1$–$X_n$ and the row electrodes $Y_1$–$Y_n$ alternately and repeatedly. When the supply frequency during the light emission maintaining process Ic of the subfield SF1 is "1", the supply frequency (or the supply period) of the maintaining pulses $IP_X$ and $IP_Y$ during the light emission maintaining process Ic of each subfield SF1–SF4 shown in FIG. 2 is as follows.

SF1: 1
SF2: 2
SF3: 4
SF4: 8

In this case, each time these maintaining pulses $IP_X$ and $IP_Y$ are supplied, only a discharge cell having a wall charge remaining in its discharge space, namely, a "light emitting cell" discharges (hereinafter called maintenance discharge). That is, only a discharge cell which was set to be a "light emitting cell" during said picture element data write process Wc emits light accompanied by said maintenance discharge repeatedly by a frequency allocated to each subfield as described above, and maintains its light emitting state.

During the next erasing process E, the driver 100 supplies erasing pulses EP as shown in FIG. 3 to the row electrodes $Y_1$–$Y_n$ at the same time. By the supply of such erasing pulses EP, all the discharge cells of the PDP 10 perform erasing discharge, and the wall charge remaining in such discharge cell disappears.

By the above-mentioned driving, a write discharge is selectively generated in each discharge cell in accordance with the input video signal. Only a discharge cell in which said write discharge was generated repeats light emission due to maintenance discharge by a frequency allocated to such subfield. In this case, intermediate brightness corresponding to the total number of light emissions performed in each subfield during one field display period is visible.

By the above-mentioned various kinds of discharge, in the PDP 10, a discharge current flows from the driver 100 to a discharge cell to be discharged through the row electrodes. In this case, a voltage drop occurs in the driving pulses supplied to the row electrodes because of the electric resistance of the row electrodes themselves. Especially, the voltage drop of the supplied driving pulses of the discharge cell $G_{11}$ on the side of the driver 100 as shown in FIG. 1 is different from that of the discharge cell $G_{1m}$. In addition, if the number of discharge cells to be discharged on one display line increases, the discharge current flowing through such display line increases too. Therefore, the voltage drop of the driving pulses for the discharge cell $G_{1m}$ shown in FIG. 1 also increases. As a result, if the voltage of the driving pulses to be supplied to the discharge cell $G_{1m}$ falls below a predetermined level because of such voltage drop, a desired amount of the wall charge is no longer formed in the discharge cell $G_{1m}$. As a result, when said maintenance discharge takes place, a predetermined emission brightness can not be obtained. Therefore, in this case, the emission brightness of the discharge cell $G_{11}$ shown in FIG. 1 is different from that of the discharge cell $G_{1m}$, resulting in an "uneven brightness" in one display screen and deterioration of display quality.

The number of discharge cells to be discharged on one display line is not necessarily the same in all the subfields, so the brightness drop of each subfield is different from the others, so tone disturbance may occur.

OBJECT AND SUMMARY OF THE INVENTION

It is an object of the present invention to solve said problems and to provide a plasma display apparatus which can display tone excellently.

A plasma display apparatus according to the present invention comprises a plasma display panel forming a discharge cell for a picture element at each intersection of a plurality of row electrodes carrying a display line and a plurality of column electrodes intersecting with said row electrodes; and a driver for forming one field display period of an input video signal with a plurality of subfields and driving the tone of said plasma display panel, said driver comprising a picture element data write driver for generating scanning pulses for causing discharge selectively for setting each of said discharge cells to a light emitting state or a non-light emitting state in response to picture element data corresponding to said input video signal, and supplying such scanning pulses to each of said row electrodes sequentially; a light emission maintenance driver for generating maintaining pulses for causing maintenance discharge for emitting said discharge cells in said light emitting cell state only repeatedly and supplying the maintaining pulses to each of said row electrodes; an impedance estimator for obtaining estimated impedance by estimating the impedance of said plasma display panel based on said picture element data; and a pulse width controller for changing the pulse width of said scanning pulses and said maintaining pulses in accordance with said estimated impedance.

BRIEF DESCRIPTION OF THE DRAWINGS

FIG. 7 shows an example of the line impedance of first to fourth display lines in subfields SF1 and SF2;

DETAILED DESCRIPTION OF THE PREFERRED EMBODIMENT

Figure 1:
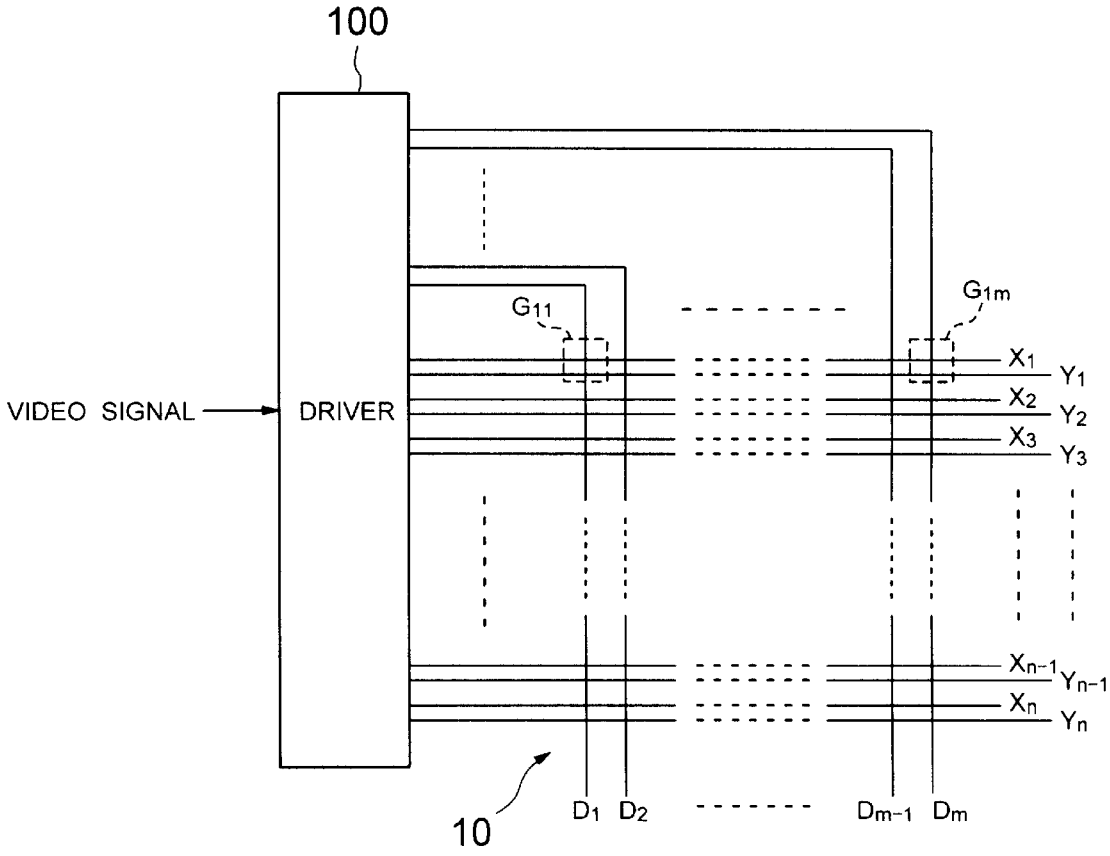
FIG. 1 is a schematic view of a plasma display apparatus.
Figure 2:
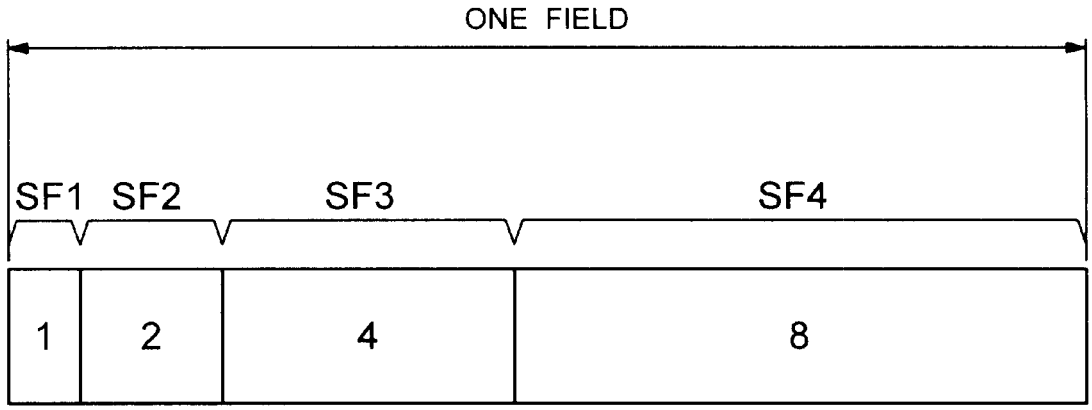
FIG. 2 is a diagram of conventional brightness tone control operation based on the subfield method.
Figure 3:
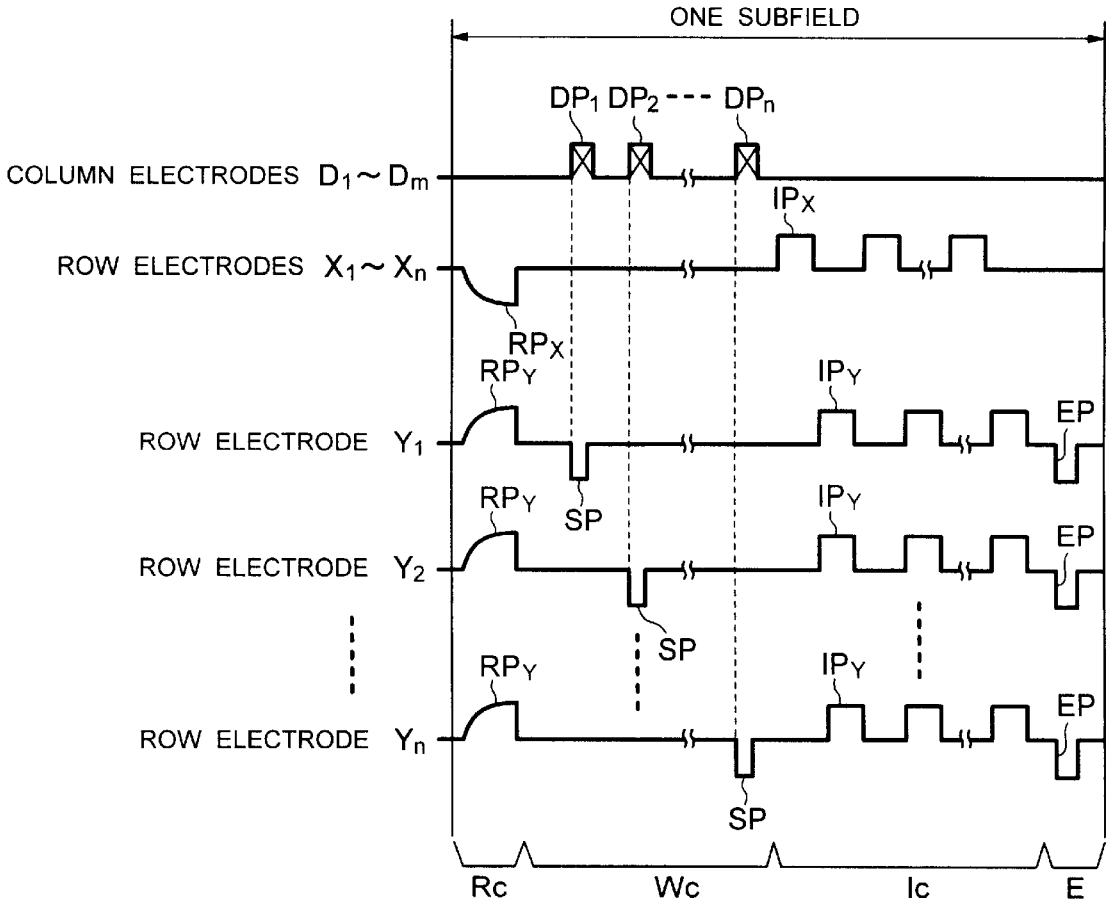
FIG. 3 shows various kinds of driving pulses to be supplied to PDP 10 and their supply timing in one subfield.
Figure 4:
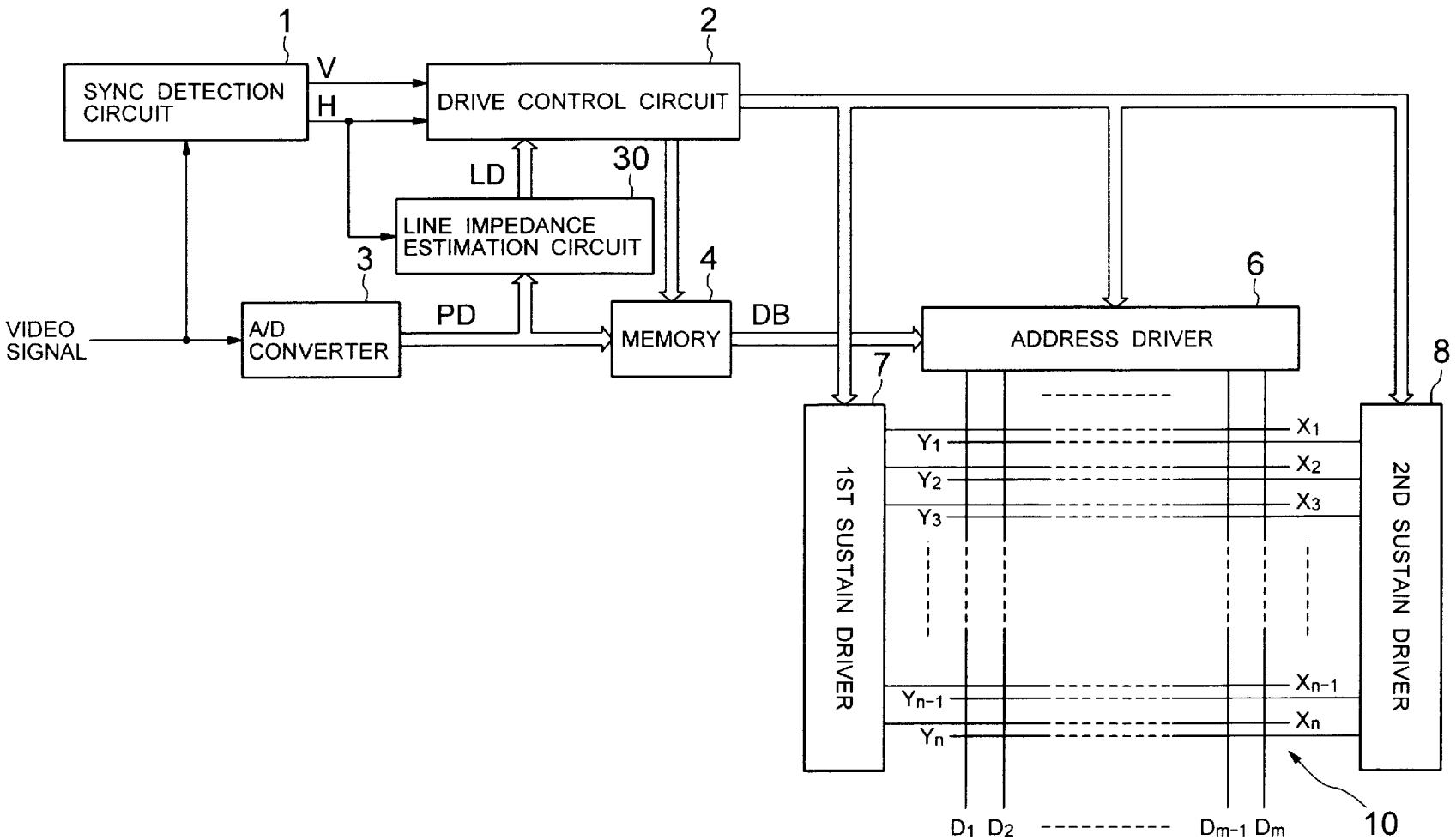
FIG. 4 is a schematic configuration of a plasma display apparatus of the present invention.

FIG. 4 is a schematic configuration of a plasma display apparatus according to the present invention.

As is shown in FIG. 4, the plasma display apparatus comprises a plasma display panel PDP 10 and a driver consisting of various kinds of functional modules.

In FIG. 4, the PDP 10 comprises m column electrodes $D_1$–$D_m$ as address electrodes, and n row electrodes $X_1$–$X_n$ and $Y_1$–$Y_n$ which intersect each of these column electrodes. Each of the row electrodes $X_1$–$X_n$ and each of the row electrodes $Y_1$–$Y_n$ form the first display line to the n-th display line in the PDP 10 as a pair of row electrodes $X_i$ ($1 \leqq i \leqq n$) and $Y_i$ ($1 \leqq i \leqq n$). A discharge space filled with discharge gas is formed between the column electrode D and the row electrodes X and Y. It is so configured that a discharge cell corresponding to one picture element is formed at the intersection of each row electrode and each column electrode containing said discharge space. That is, there are m discharge cells on one display line, m being the number of column electrodes D.

Figure 5:
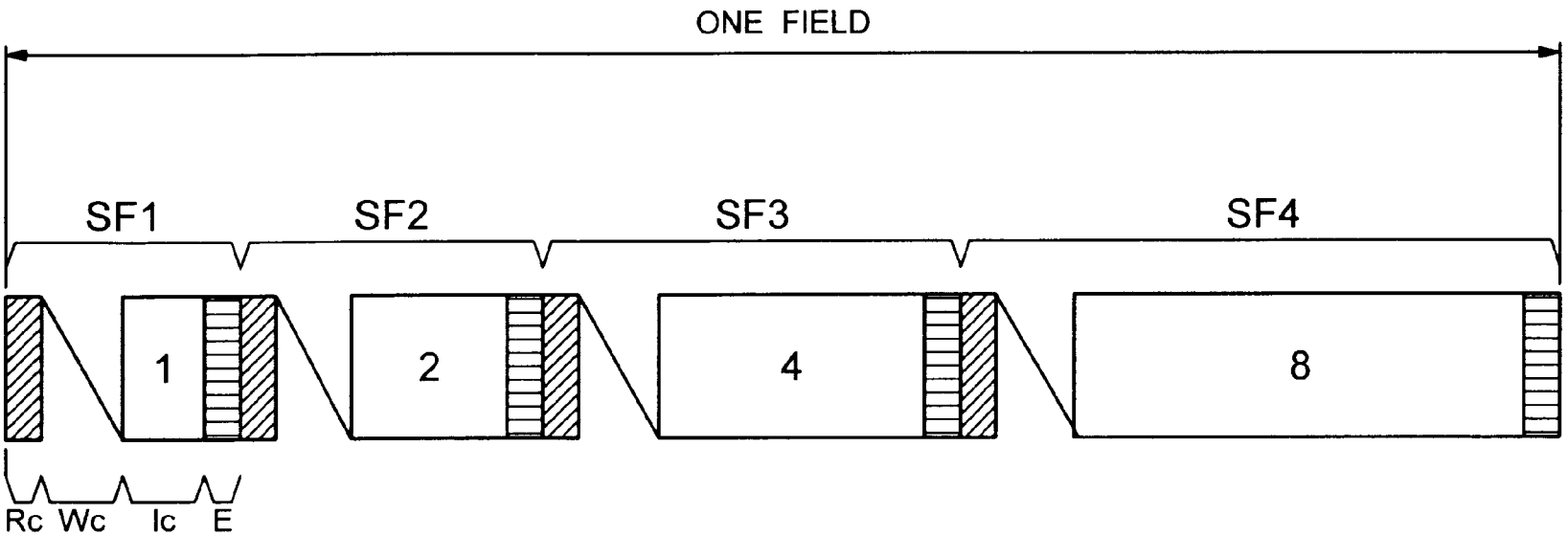
FIG. 5 shows a light emission driving format to be used in the plasma display apparatus in FIG. 4.

The driver comprises a synchronism detection circuit 1, a drive control circuit 2, an A/D converter 3, a memory 4, an address driver 6, a first sustain driver 7, and a second sustain driver 8. Said driver divides one field display period into four subfields SF1–SF4 as shown in FIG. 5, and drives the tone of the PDP 10 in accordance with the subfield method as described above. In this case, the driver performs the simultaneous reset process Rc, the picture element data write process Wc, the light emission maintaining process Ic, and the erasing process E in each subfield.

The synchronism detection circuit 1 generates a vertical synchronization detecting signal V when it detects a vertical synchronization signal in the input video signal and a horizontal synchronization detecting signal H when it detects a horizontal synchronization signal. The generated detecting signals are supplied to the drive control circuit 2. The synchronism detection circuit 1 supplies the horizontal synchronization detecting signal H to a line impedance estimation circuit 30. The A/D converter 3 samples the input video signal, converts it into 4-bit picture element data PD indicating the brightness level of each picture element, and supplies said picture element data PD to the line impedance estimation circuit 30 and the memory 4.

The line impedance estimation circuit 30 estimates the line impedance of each display line of the PDP 10 for each subfield based on the picture element data PD, and supplies impedance information LD indicating said impedance to the drive control circuit 2.

For example, the line impedance estimation circuit 30 extracts the first bits only from the picture element data PD supplied sequentially from the A/D converter 30, and counts the number of the first bits that are logical level "1" for each display line. In this case, if the first bit of the picture element data PD is logical level "1", it indicates that the discharge cell corresponding to the picture element data is generated to discharge (to be described) during the picture element data write process Wc and the light emission maintaining process Ic of the subfield SF1. That is, the line impedance estimation circuit 30 determines the discharge cell to be generated to discharge in the subfield SF1 by using the first bit of the picture element data PD, and counts the number of them for each display line. The counted result obtained for each display line (the 1st to n-th display lines) is supplied to the drive control circuit 2 as impedance information $LD1_1$–$LD1_n$ indicating the line impedance for each of the first to n-th display lines in the subfield SF1. Next, the line impedance estimation circuit 30 extracts the second bits only from the picture element data PD supplied sequentially from the A/D converter 30, and counts the number of second bits that are logical level "1" for each display line. In this case, if the second bit of the picture element data PD is logical level "1", it indicates that the discharge cell corresponding to the picture element data is generated to discharge (to be described) during the picture element data write process Wc and the light emission maintaining process Ic of the subfield SF2. That is, the line impedance estimation circuit 30 determines the discharge cell to be generated to discharge in the subfield SF2 by using the second bit of the picture element data PD, and counts the number of them for each display line. The counted result obtained for each of the 1st to n-th display lines is supplied to the drive control circuit 2 as impedance information $LD2_1$–$LD2_n$ indicating the line impedance for each of the first to n-th display lines in the subfield SF2. In the same way, the line impedance estimation circuit 30 extracts the third bits only from the picture element data PD supplied sequentially from the A/D converter 30, and counts the number of the third bits that are logical level "1" for each display line. In this case, if the third bit of the picture element data PD is logical level "1", it indicates that the discharge cell corresponding to the picture element data is to be generated to discharge during the picture element data write process Wc and the light emission maintaining process Ic of the subfield SF3. That is, the line impedance estimation circuit 30 determines the discharge cell to be generated to discharge in the subfield SF3 by using the third bit of picture element data PD, and counts the number of them for each display line. The counted result obtained for each of the 1st to n-th display lines is supplied to the drive control circuit 2 as impedance information $LD3_1$–$LD3_n$ indicating the line impedance for each of the first to n-th display lines in the subfield SF3. Furthermore, the line impedance estimation circuit 30 extracts the fourth bits only from the picture element data PD supplied sequentially from the A/D converter 30, and counts the number of the fourth bits that are logical level "1" for each display line. In this case, if the fourth bit of the picture element data PD is logical level "1", it indicates that the discharge cell corresponding to the picture element data is to be generated to discharge during the picture element data write process Wc and the light emission maintaining process Ic in the subfield SF4. That is, the line impedance estimation circuit 30 determines the discharge cell to be generated to discharge in the subfield SF4 by using the fourth bit of the picture element data PD, and counts the number of them for each display line. The counted result obtained for each of the 1st to n-th display lines is supplied to the drive control circuit 2 as impedance information $LD4_1$–$LD4_n$ indicating the line impedance for each of the first to n-th display lines in the subfield SF4.

The memory 4 sequentially writes the picture element data PD supplied from the A/D converter 3 in response to the write signal supplied from the drive control circuit 2. The memory 4 then performs a read operation described below each time the writing of picture element data PD for one screen is over, namely, whenever the writing is completed for (n_~m) picture element data PD including picture element data $PD_{11}$ corresponding to the picture element of the first row and the first column through picture element data $PD_{nm}$ corresponding to the picture element of the n-th row and the m-th column.

First, in the leading subfield SF1, the memory 4 regards the first bit of each picture element data $PD_{11}$–$PD_{nm}$ as the driving picture element data bits $DB1_{11}$–$DB1_{nm}$, reads them for one display line at a time, and supplies them to the address driver 6. In the next subfield SF2, the memory 4 regards the second bit of each picture element data $PD_{11}$–$PD_{nm}$ as the driving picture element data bits $DB2_{11}$–$DB2_{nm}$, reads them for one display line at a time, and supplies them to the address driver 6. In the subfield SF3, the memory 4 regards the third bit of each picture element data $PD_{11}$–$PD_{nm}$ as the driving picture element data bits $DB3_{11}$–$DB3_{nm}$, reads them for one display line at a time, and supplies them to the address driver 6. In the last subfield SF4, the memory 4 regards the fourth bit of each picture element data $PD_{11}$–$PD_{nm}$ as the driving picture element data bits $DB4_{11}$–$DB4_{nm}$, reads them for one display line at a time, and supplies them to the address driver 6.

The drive control circuit 2 generates various kinds of timing signals for driving the tone of the PDP 10 in accordance with a light emission driving format as shown in FIG. 5, and supplies such signals to the address driver 6, the first sustain driver 7, and the second sustain driver 8.

Figure 6:
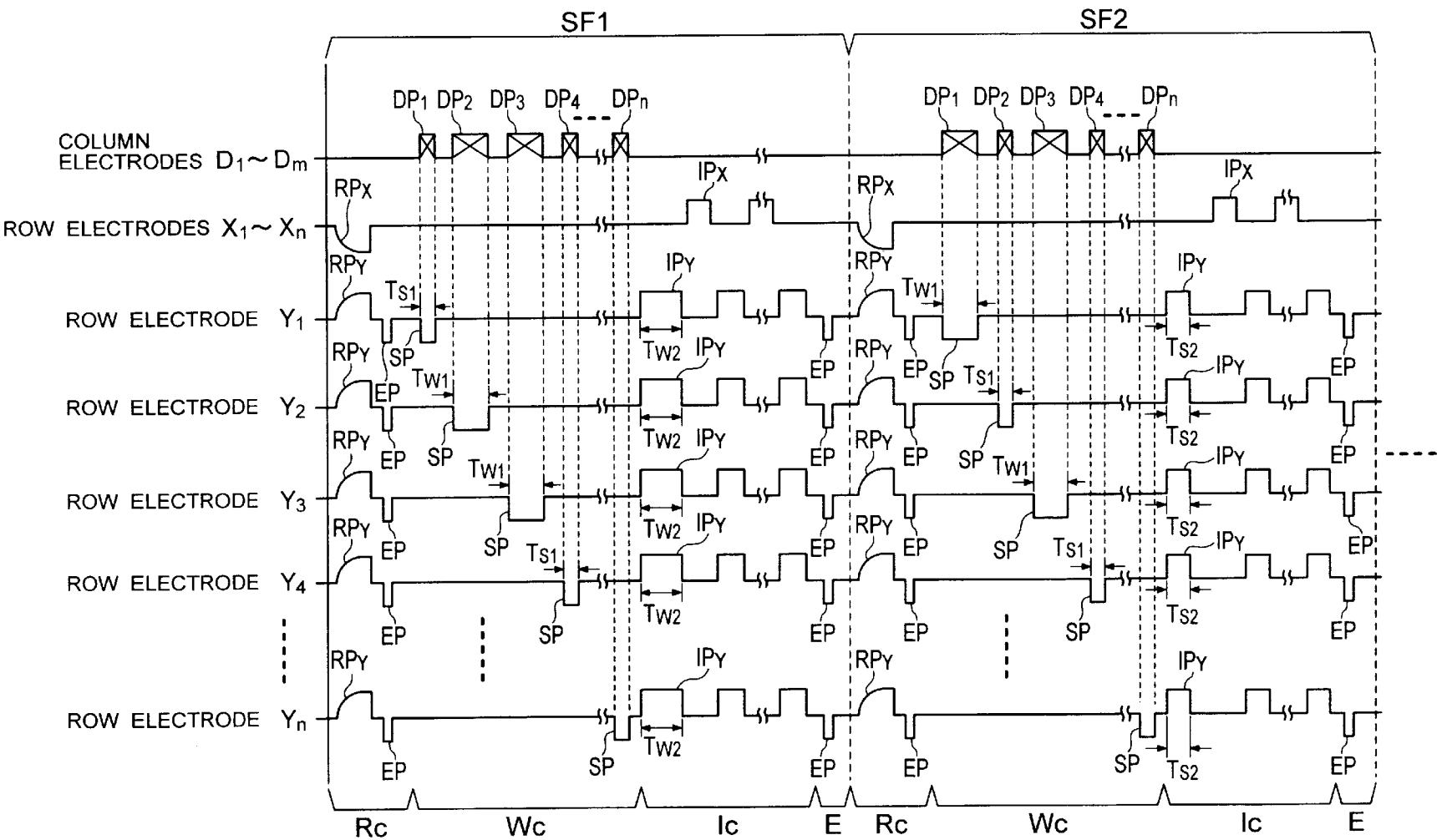
FIG. 6 shows various kinds of driving pulses to be supplied to PDP 10 and an example of their supply timing.

FIG. 6 is a diagram showing the various kinds of driving pulses to be applied to the column electrodes and row electrodes of the PDP 10 by the address driver 6, the first sustain driver 7, and the second sustain driver 8 in accordance with the light emission driving format shown in FIG. 5, and also their application timing. In FIG. 6, operation in the subfields SF1 and SF2 only is shown being extracted from the subfields SF1–SF4.

In FIG. 6, during the simultaneous reset process Rc which is performed at the head of each subfield, the first sustain driver 7 generates negative reset pulses $RP_X$ as shown in FIG. 6, and applies them to the row electrodes $X_1$–$X_n$. Simultaneously with the generation of said reset pulses $RP_X$, the second sustain driver 8 generates positive reset pulses $RP_Y$ as shown in FIG. 6, and applies them to the row electrodes $Y_1$–$Y_n$. In response to the simultaneous application of these reset pulses $RP_X$ and $RP_Y$, a reset discharge is generated in all the discharge cells of the PDP 10, and a wall charge is formed in each discharge cell. Immediately after that, the second sustain driver 8 generates negative erasing pulses EP as shown in FIG. 6, and applies them to the row electrodes $Y_1$–$Y_n$. In response to the application of the erasing pulses EP, an erasing discharge is generated in all the discharge cells, and the wall charge that had been formed in the discharge cells as described above disappears. In this way, all the discharge cells are initialized to the "non-light emitting cell" state.

During the picture element data write process Wc, the address driver 6 generates picture element data pulses containing a pulse voltage corresponding to the driving picture element data bit DB supplied from the memory 4. For example, the address driver 6 generates high voltage picture element data pulses when the logical level of the driving picture element data bit DB is "1", and generates low voltage (0 volt) picture element data pulses when the logical level is "0". The address driver 6 then matches the above-mentioned picture element data pulses to each of the first to n-th display lines, groups them for each display line into picture element data pulse groups $DP_1$–$DP_n$, and applies them to the column electrodes $D_1$–$D_m$ sequentially, as shown in FIG. 6. In addition, during the picture element data write process Wc, the second sustain driver 8 generates negative scanning pulses SP in the same timing as the application timing of each of the picture element data pulse groups $DP_1$–$DP_n$, and applies them to the row electrodes $Y_1$–$Y_n$ sequentially, as shown in FIG. 6. In this case, discharge (selective write discharge) occurs only at a discharge cell at the intersection of a display line to which said scanning pulses SP are applied and a "column" to which high voltage picture element data pulses are applied. The voltage application by the scanning pulses SP and the picture element data pulse group DP is continuously performed even after the selective write discharge comes to an end, so a wall charge is gradually formed in the discharge cell, and the discharge cell is put in the "light emitting cell" state. On the other hand, at a discharge cell to which the scanning pulses SP are applied and at the same time the low voltage picture element data pulses are also applied, said selective write discharge is not generated. Thus, that discharge cell is maintained at the state initialized during the simultaneous reset process Rc, namely, at the "non-light emitting cell" state. As a result, each discharge cell of the PDP 10 is set to a state corresponding to the above-mentioned picture element data PD ("light emitting cell" or "non-light emitting cell") during the picture element data write process Wc.

During said picture element data write process Wc, the pulse width of each of the picture element data pulse groups $DP_1$–$DP_n$ and of the scanning pulses SP is changed to a pulse width for each display line so as to correspond to the line impedance of the display line.

The operation for changing the pulse width of each of the picture element data pulse groups $DP_1$–$DP_n$ and of the scanning pulses SP will be described below.

The drive control circuit 2 first obtains line impedance information for each of the first to n-th display lines for each subfield from the impedance information LD supplied from the line impedance estimation circuit 30. Then the drive control circuit 2 individually compares the height of each line impedance corresponding to each of the first to n-th display lines with the height of a predetermined impedance. In this case, when the line impedance is higher than the predetermined impedance, the drive control circuit 2 controls the second sustain driver 8 so as to set the pulse width of the scanning pulses SP to be applied to the display line to a wider pulse width (hereinafter called wide pulse width). The drive control circuit 2 further controls the address driver 6 so as to set the pulse width of the picture element data pulse group DP to be applied in the same timing as that of the scanning pulses SP to said wide pulse width too. On the other hand, when the line impedance is lower than said predetermined impedance, the drive control circuit 2 controls the second sustain driver 8 so as to set the pulse width of the scanning pulses SP to be applied to the display line to a narrower pulse width (hereinafter called narrow pulse width). The drive control circuit 2 also controls the address driver 6 so as to set the pulse width of the picture element data pulse group DP to be applied in the same timing as that of the scanning pulses SP to said narrow pulse width.

Therefore, if the relation of the height of the line impedance of each of the first to fourth display lines with the height of the predetermined impedance is as shown in FIG. 7, for example, the picture element data pulse group DP and the scanning pulses SP having a narrow pulse width $T_{S1}$ or a wide pulse width $T_{W1}$ as shown in FIG. 6 are applied to the PDP 10. That is, in the subfield SF1, because the line impedance at the first and fourth display lines is lower than the predetermined impedance, the address driver 6 applies the picture element data pulse groups $DP_1$ and $DP_4$ having a narrow pulse width $T_{S1}$ to the column electrodes. In this case, the second sustaining driver 8 applies scanning pulses SP having a narrow pulse width $T_{S1}$ as shown in FIG. 6 to the row electrodes $Y_1$ and $Y_4$ respectively in the same application timing as the picture element data pulse groups $DP_1$ and $DP_4$ are applied. In the subfield SF1, because the line impedance at the second and third display lines is higher than the predetermined impedance, the address driver 6 applies the picture element data pulse groups $DP_2$ and $DP_3$ having a wide pulse width $T_{W1}$ to the column electrodes. In this case, as shown in FIG. 6, the second sustaining driver 8 applies scanning pulses SP having wide pulse width $T_{W1}$ to the row electrodes $Y_2$ and $Y_3$ respectively in the same application timing as the picture element data pulse groups $DP_2$ and $DP_3$ are applied. On the other hand, in the subfield SF2, because the line impedance at the second and fourth display lines is lower than the predetermined impedance, the address driver 6 applies the picture element data pulse groups $DP_2$ and $DP_4$ having a narrow pulse width $T_{S1}$ to the column electrodes. In this case, as shown in FIG. 6, the second sustaining driver 8 applies scanning pulses SP having a narrow pulse width $T_{S1}$ to the row electrodes $Y_2$ and $Y_4$ in the same application timing as the picture element data pulse groups $DP_2$ and $DP_4$ are applied. In the subfield SF2, because the line impedance at the first and third display lines is higher than the predetermined impedance, the address driver 6 applies the picture element data pulse groups $DP_1$ and $DP_3$ having a wide pulse width $T_{W1}$ to the column electrodes. In this case, as shown in FIG. 6, the second sustaining driver 8 applies scanning pulses SP having a wide pulse width $T_{W1}$ to the row electrodes $Y_1$ and $Y_3$ in the same application timing as the picture element data pulse groups $DP_1$ and $DP_3$ are applied.

In this manner, during the picture element data write process Wc, the pulse width of the driving pulses (picture element data pulse group DP, scanning pulses SP) to be applied to a display line is narrowed when the line impedance of the display line is low and the pulse width is widened when the line impedance of the display line is high.

During the light emission maintaining process Ic in each subfield, the first sustain driver 7 and the second sustain driver 8 alternately apply positive maintaining pulses $IP_X$ and $IP_Y$ to the row electrodes $X_1$–$X_n$ and $Y_1$–$Y_n$, as shown in FIG. 6. In this case, when the application frequency in the subfield SF1 is "1", the application frequency (or application period) to apply maintaining pulses IP during each light emission maintaining process Ic is as shown below.

SF1: 1
SF2: 2
SF3: 4
SF4: 8

By such operation, only a discharge cell having a wall charge remaining therein, namely, a discharge cell at the "light emitting cell" state generates a maintenance discharge each time the maintaining pulses $IP_X$ and $IP_Y$ are applied, and maintains the light emitting state accompanied by the maintenance discharge by said frequency (or period).

The pulse width of the head pulse of the maintaining pulses $IP_Y$, which are to be applied repeatedly during the light emission maintaining process Ic, is set to a pulse width corresponding to the impedance of the PDP 10 in the subfield to which the light emission maintaining process Ic belongs.

The operation for setting the pulse width of the maintaining pulses $IP_Y$ to be applied at the head of the light emission maintaining process Ic will be described below.

The drive control circuit 2 first obtains line impedance information for each of the first to n-th display lines for each subfield from the impedance information LD supplied from the line impedance estimation circuit 30. Next, the drive control circuit 2 individually compares the height of each line impedance corresponding to each of these first to n-th display lines with the height of a predetermined impedance. Then the drive control circuit 2 counts the number of high impedance display lines in which the line impedance is higher than the predetermined impedance and the number of low impedance display lines in which the line impedance is lower than the predetermined impedance, and compares the size of the two numbers. By comparing the size of the two numbers, the drive control circuit 2 judges whether overall impedance at each display line of the PDP 10, namely, what is called panel impedance, is high impedance or low impedance for each subfield. In this case, if the panel impedance of the PDP 10 is judged to be high impedance, the drive control circuit 2 controls the second sustain driver 8 so as to set the pulse width of the maintaining pulses $IP_Y$ to be applied first to each of the row electrodes $Y_1$–$Y_n$ during the light emission maintaining process Ic of the subfield to the wide pulse width. On the other hand, if the panel impedance of the PDP 10 is judged to be low impedance, the drive control circuit 2 controls the second sustain driver 8 so as to set the pulse width of the maintaining pulses $IP_Y$ to be applied first to the row electrodes $Y_1$–$Y_n$ during the light emission maintaining process Ic of the subfield to the narrow pulse width.

Therefore, when the panel impedance of the PDP 10 is low impedance, as is shown in the light emission maintaining process Ic of the subfield SF2 in FIG. 6, for example, the pulse width of the head of the maintaining pulses $IP_Y$ becomes a narrow pulse width $T_{S2}$. On the other hand, when the panel impedance is high impedance, as is shown in the light emission maintaining process Ic of the subfield SF1 in FIG. 6, the pulse width of the head of the maintaining pulses $IP_Y$ becomes wide pulse width $T_{W2}$ which is wider than said narrow pulse width $T_{S2}$.

During the erasing process E performed at the end of each subfield, the second sustain driver 8 applies erasing pulses EP as shown in FIG. 6 to the row electrodes $Y_1$–$Y_n$. Thus, all the discharge cells are made to generate an erasing discharge simultaneously, and all the wall charge remaining in each discharge cell disappears.

As described above, in order to drive the PDP 10, each discharge cell is made to generate a write discharge selectively in response to an input video signal so as to form a wall charge thereat by performing the picture element data write process Wc first in each subfield. Next, during the light emission maintaining process Ic in each subfield, only a discharge cell at which a wall charge has been formed ("light emitting cell") is made to generate a maintenance discharge by a frequency (or a period) allocated to the subfield so as to continue the light emitting state accompanied by this maintenance discharge. Therefore, the light emission is repeated by a frequency (or a period) corresponding to the brightness level of the input video signal through one field display period, and the intermediate brightness corresponding to the input video signal is visible.

In this case, on a display line where many discharge cells generate a selective write discharge during the picture element data write process Wc, namely, on a display line where impedance is high, more discharge current due to the selective write discharge flows than on a display line where impedance is low. On a display line with high impedance, the discharge current due to the maintenance discharge is also greater than that on a display line with low impedance. However, since there is electric resistance in a row electrode which governs a display line, the voltage drop on the display line increases as the discharge current grows larger. Thus, the voltage of the scanning pulses SP and maintaining pulses IP applied to the display line drops. If the voltage of the scanning pulses SP (or maintaining pulses IP) drops, a delay occurs by that amount in the time between the generation of the selective write discharge (or maintenance discharge) and the time when the wall charge formed in a discharge cell reaches a desired amount. As a result, if voltage application by scanning pulses SP (or maintaining pulses IP) is stopped before the desired amount of wall charge is obtained, the amount of wall charge in the discharge cell becomes insufficient, and the predetermined emission brightness becomes unobtainable during the maintenance discharge.

Therefore, according to the present invention, the pulse width of the scanning pulses SP to be applied to the PDP 10 during the picture element data write process Wc is changed for each display line corresponding to the line impedance thereof. Particularly, for a display line having high line impedance, the pulse width of both the scanning pulses SP to be applied to the display line and the picture element data pulses to be applied simultaneously with the scanning pulses SP is set wider. In addition, the pulse width of the maintaining pulses IP to be applied to the PDP 10 during the light emission maintaining process Ic is changed corresponding to the panel impedance of the PDP 10. Particularly, when the panel impedance of the PDP 10 is high impedance, the pulse width of the maintaining pulses IP to be applied first during the light emission maintaining process Ic of the subfield is set wider.

As a result, even though a delay is caused in the speed of wall charge formation due to a voltage drop in the row electrode driving pulses such as scanning pulses SP or maintaining pulses IP, the voltage application performed by such row electrode driving pulses is continued by the amount considered for the delay. Therefore, the wall charge in the discharge cell reaches the desired amount. Thus, according to the present invention, it becomes possible to force a discharge cell to emit light having a uniform brightness level wherever the discharge cell is located in the display screen and regardless of the line impedance of each display line of the PDP.

In addition, according to the present invention, the change of scanning pulse width for each display line is performed for each subfield individually as described above. Therefore, tone disturbance does not occur even though the line impedance on one display line is different in each subfield.

Figure 8:
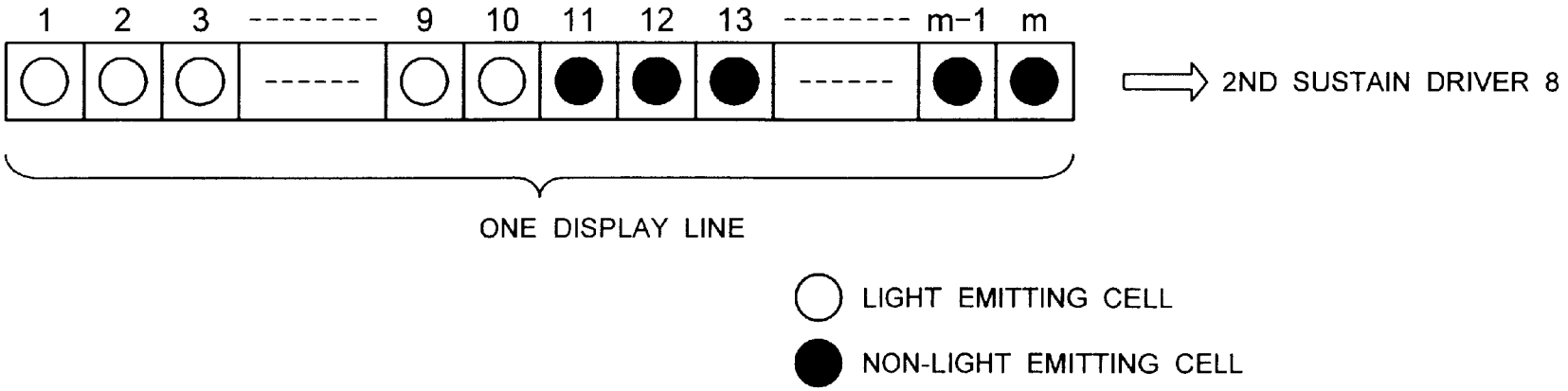
FIG. 8 shows an example of an emission pattern on one display line when the discharge cells in a "light emitting cell" state are concentrated at a position far from the second sustain driver 8.

In the above-mentioned embodiment, the line impedance is regarded as the number of discharge cells to be discharged on one display line, namely, as an integrated value of the number of "light emitting cells". However, the impedance on a display line becomes higher when a discharge is generated at a discharge cell located far from the second sustain driver 8, which is the supply source of the driving pulses, than when a discharge is generated at a discharge cell located near the second sustain driver 8. Therefore, the number of "light emitting cell" on one display line is integrated with heavier weighting for a discharge cell located farther from the second sustain driver 8. The degree of impedance is judged based on this integrated result. For example, when the light emitting pattern of each discharge cell on one display line is as shown in FIG. 8, that is, all the discharge cells in the first to tenth columns are "light emitting cells" (shown with circles) and all the discharge cells in the eleventh to m-th columns are "non-light emitting cells" (shown with black dots), the number of "light emitting cell" on one display line is only ten. However, because the discharge cells in the first to 10th columns on the display line are located far from the second sustain driver 8, the impedance of the display line may be high even though the number of discharge cells at the "light emitting cell" state is small. By means of the weighted integration described above, it becomes possible to judge the display line to be a high impedance line properly even in such a case.

In the above-mentioned embodiment, the pulse width of each of scanning pulses SP and picture element data pulse group DP is designed to be changed for each display line corresponding to the line impedance of the display line. However, the present invention may be designed so that the pulse width of each driving pulse is changed by a unit of one subfield or one field in accordance with the panel impedance of the PDP 10 through one subfield display period or one field display period. That is, when the panel impedance of the PDP 10 is high through one subfield display period or one field display period, the pulse width is set wider in the scanning pulses SP, picture element data pulse group DP, and maintaining pulses $IP_X$ and $IP_Y$ to be applied to the PDP 10 in the subfield or in one field. On the other hand, when panel impedance is low, the pulse width is set narrower in the of scanning pulses SP, picture element data pulse group DP, in the pulses $IP_X$ and $IP_Y$ to be applied to the PDP 10 in the subfield or the field.

In the above-mentioned embodiment, a malfunction due to a voltage drop in the driving pulses (wall charge formation becomes incomplete) is prevented by setting the pulse width wider in the various kinds of driving pulses as described above. However, instead of changing the pulse width of the driving pulses, the pulse voltage of the driving pulses may be changed with the above-mentioned voltage drop considered.

Figure 9:
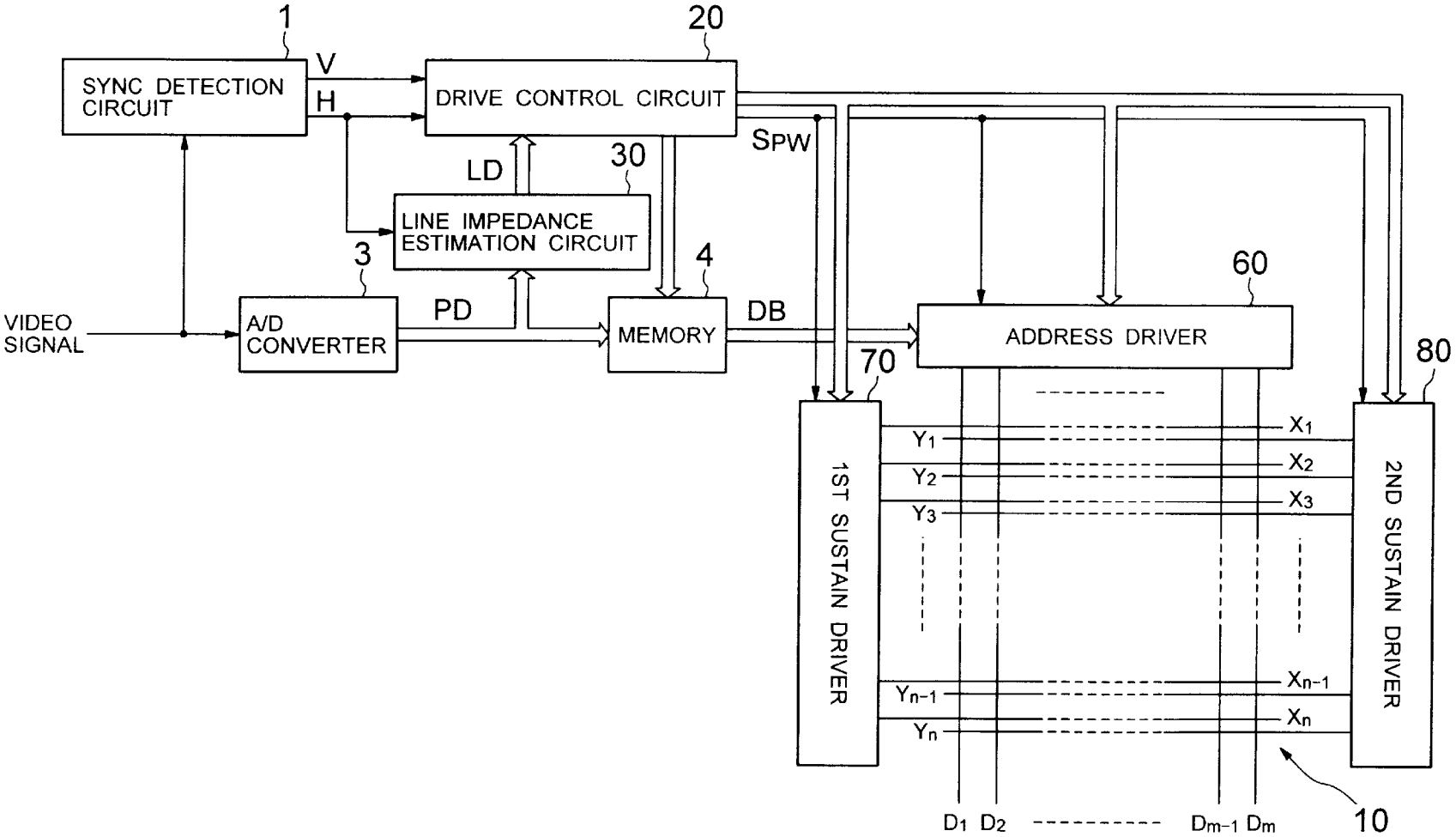
FIG. 9 is a diagram of another configuration of a plasma display apparatus.

FIG. 9 is a diagram of another configuration of a plasma display apparatus which is designed to take these points into consideration.

In FIG. 9, the operations performed by the PDP 10, the synchronism detection circuit 1, the A/D converter 3, the memory 4, and the line impedance estimation circuit 30 are in FIG. 4, so a description about has been omitted.

In FIG. 9, a drive control circuit 20 obtains the panel impedance of the PDP 10 through one subfield display period or one field display period based on the impedance information LD of each subfield supplied from the line impedance estimation circuit 30. When the panel impedance is low impedance, the drive control circuit 20 supplies a power supply voltage selecting signal $S_{PW}$ of logical level "0" which selects the low voltage power supply as the driver power supply to an address driver 60, a first sustain driver 70, and a second sustain driver 80. On the other hand, when the panel impedance of the PDP 10 is high impedance, the drive control circuit 20 supplies a power supply voltage selecting signal $S_{PW}$ of logical level "1" which selects the high voltage power supply as the driver power supply to the address driver 60, first sustain driver 70, and second sustain driver 80.

The drive control circuit 20 further generates various kinds of timing signals for driving the tone of the PDP 10 in accordance with a light emission driving format as shown in FIG. 5, and supplies them to the address driver 60, first sustain driver 70, and the second sustain driver 80.

Figure 10:
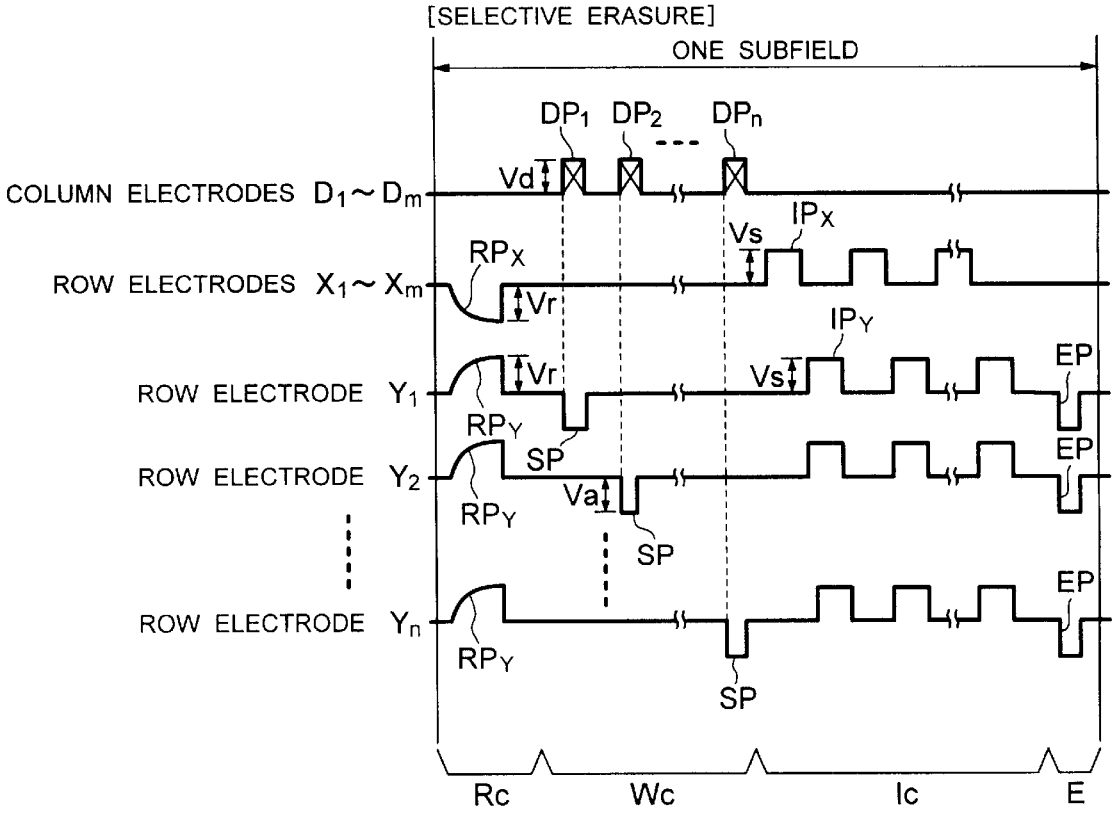
FIG. 10 shows various kinds of driving pulses to be supplied to PDP 10 in the plasma display apparatus in FIG. 9 and an example of their supply timing.

FIG. 10 is a diagram of various kinds of driving pulses to be applied to the pairs of column electrodes and row electrodes of the PDP 10 by the address driver 60, first sustain driver 70, and second sustain driver 80 in accordance with the light emission driving format shown in FIG. 5, and their application timing. In FIG. 10, the operation performed in one subfield only is extracted and shown.

In FIG. 10, during the simultaneous reset process Rc to be executed at the head of each subfield, the first sustain driver 70 generates reset pulses $RP_X$ having negative pulse voltage Vr as shown in FIG. 10, and applies them to the row electrodes $X_1$–$X_n$. At the same time that said reset pulses $RP_X$ are generated and applied, the second sustain driver 80 generates reset pulses RP, having positive pulse voltage Vr as shown in FIG. 10, and applies them to the row electrodes $Y_1$–$Y_n$. The first sustain driver 70 and the second sustain driver 80 are each equipped with two power supply systems, namely, a high voltage power supply for reset pulses for generating a high power supply voltage and low voltage power supply for reset pulses for generating a low power supply voltage. These drivers select one of the two power supply systems corresponding to the logical level of the power supply voltage selecting signal $S_{PW}$ supplied from the drive control circuit 20, and generate said reset pulses $RP_X$ and $RP_Y$ having pulse voltage Vr which is low or high power supply voltage. That is, when the power supply voltage selecting signal $S_{PW}$ at logical level "0" which selects low voltage power supply is supplied, the pulse voltage Vr of each of the reset pulses $RP_X$ and $RP_Y$ becomes low voltage. On the other hand, when the power supply voltage selecting signal $S_{PW}$ at logical level "1" which selects high voltage power supply is supplied, pulse voltage Vr becomes high voltage.

In response to the simultaneous application of said reset pulses $RP_X$ and $RP_Y$, a reset discharge is generated at all the discharge cells of the PDP 10, and a wall charge is formed in each discharge cell. Thus, all the discharge cells are initialized to the "light emitting cell" state.

Next, during the picture element data write process Wc shown in FIG. 10, the address driver 6 generates picture element data pulses having a pulse voltage corresponding to driving picture element data bit DB supplied from the memory 4. For example, the address driver 6 generates picture element data pulses having pulse voltage Vd as shown in FIG. 10 when the logical level of the driving picture element data bit DB is "1", and generates picture element data pulses having low voltage (0 volt) when the logical level is "0". In this case, the address driver 6 is equipped with two power supply systems consisting of high voltage power supply for generating high power supply voltage and low voltage power supply for generating low power supply voltage. The address driver 6 selects one of the two power supply systems corresponding to the logical level of the power supply voltage selecting signal $S_{PW}$ supplied from the drive control circuit 20, and generates said picture element data pulses having pulse voltage Vd from the power supply voltage. That is, when the power supply voltage selecting signal $S_{PW}$ at logical level "0" which selects the low voltage power supply is supplied to the address driver 6, the pulse voltage Vd of the picture element data pulses becomes low voltage. On the other hand, when the power supply voltage selecting signal $S_{PW}$ at logical level "1" which selects the high voltage power supply is supplied, the pulse voltage Vd becomes high voltage. Next, the address driver 6 applies picture element data pulse group $DP_1$–$DP_n$, which are said picture element data pulses coordinated with each of the first to n-th display lines and grouped for one display line, to the column electrodes $D_1$–$D_m$ sequentially as shown in FIG. 10.

In addition, during the picture element data write process Wc, the second sustain driver 8 generates scanning pulses SP having negative pulse voltage Va as shown in FIG. 10 in the same timing as the application timing of each of the picture element data pulse group $DP_1$–$DP_n$, and applies them to the row electrodes $Y_1$–$Y_n$ sequentially as shown in FIG. 10. In this case, the second sustain driver 8 is equipped with two power supply systems for scanning pulses, namely, a high voltage power supply for scanning pulses for generating high power supply voltage a low voltage power supply for scanning pulses for generating low power supply voltage. The second sustain driver 8 selects one of these two power supply systems for scanning pulses corresponding to the logical level of the power supply voltage selecting signal $S_{PW}$, and generates scanning pulses SP having pulse voltage Va out of the power supply voltage. That is, when the power supply voltage selecting signal $S_{PW}$ at logical level "0" which selects the low voltage power supply is supplied from the drive control circuit 20, the pulse voltage Va of the scanning pulses SP becomes low voltage. When the power supply voltage selecting signal $S_{PW}$ at logical level "1" which selects the high voltage power supply is supplied, the pulse voltage Va becomes high voltage. In this case, only a discharge cell at the intersection of a display line to which said scanning pulses SP were supplied and a "column" to which the picture element data pulses having a pulse voltage Vd were supplied generates a discharge (selective erasing discharge), and the wall charge formed in the discharge cell disappears. Thus, such a discharge cell is shifted to the "non-light emitting cell" state. On the other hand, a discharge cell to which the scanning pulses SP were supplied and at the same time the low voltage picture element data pulses were also supplied does not generate the above-mentioned selective erasing discharge. Thus, this discharge cell is maintained at the state initialized during the simultaneous reset process Rc, namely, at the "light emitting cell" state. Therefore, during this picture element data write process Wc, each discharge cell of the PDP 10 is set to a state in accordance with the picture element data PD ("light emitting cell" state or "not-light emitting cell" state).

Next, during the light emission maintaining process Ic, the first sustain driver 7 and the second sustain driver 8 generate positive maintaining pulses $IP_X$ and $IP_Y$ containing a pulse voltage $V_s$ shown in FIG. 10 and supply these pulses to the row electrodes $X_1$–$X_n$ and $Y_1$–$Y_n$ alternately and repeatedly. The first sustain driver 70 and the second sustain driver 80 are each equipped with two power supply systems, namely, a high voltage power supply for maintaining pulses for generating high power supply voltage and a low voltage power supply for maintaining pulses for generating low power supply voltage. These drivers select one of the two power supply systems corresponding to the logical level of the power supply voltage selecting signal $S_{pw}$ supplied from the drive control circuit 20, and generate said maintaining pulses $IP_X$ and $IP_Y$ with pulse voltage $V_s$ out of such power supply voltage. That is, when a power supply voltage selecting signal $S_{pw}$ at logical level "0" which selects the low voltage power supply is supplied, the pulse voltage $V_s$ of said maintaining pulses $IP_X$ and $IP_Y$ becomes low voltage. On the other hand, when the power supply voltage selecting signal $S_{pw}$ at logical level "1" which selects the high voltage power supply is supplied, the pulse voltage $V_s$ becomes high voltage.

In this case, the frequency (or the period) of said maintaining pulses IP which are supplied repeatedly during the light emission maintaining process Ic of each subfield are as given below, if it is assumed that the frequency in the subfield SF1 is "1".

SF1: 1

SF2: 2

SF3: 4

SF4: 8

Therefore, only a discharge cell in which the wall charge remains, namely, only a discharge cell which is in the "light emitting cell" state, discharges for maintaining light emission each time said maintaining pulses $IP_X$ and $IP_Y$ are supplied to that discharge cell, and maintains the light emission state caused by the maintenance discharge according to said frequency (or said period).

During the erasing process E which is performed at the end of one subfield shown in FIG. 10, the second sustain driver 80 supplies erasing pulses EP shown in FIG. 6 to the row electrodes $Y_1$–$Y_n$. Thereby, all the discharge cells discharge for erasing and the wall charge in each discharge cell disappears.

As described above, in the plasma display apparatus shown in FIG. 9, the pulse voltage of various kinds of driving pulses to be supplied to the PDP 10 varies in accordance with the panel impedance of the PDP 10 during one subfield display period or one field display period. Particularly, when said panel impedance is high, the pulse voltages Vr, Va, Vd and Vd of said reset pulses $RP_X$ and $RP_Y$, scanning pulses SP, picture element data pulses, and maintaining pulses $IP_X$ and $IP_Y$ are set higher than when panel impedance is low.

In this way, even though the voltage drop of each display line becomes great because of the high panel impedance of the PDP 10, each pulse voltage of the driving pulses becomes higher in expectation of such voltage drop, so the wall charge formation speed does not slow down. Therefore, it becomes possible for any discharge cell at any location in one screen to emit light of uniform brightness regardless of the panel impedance of the PDP 10.

Figure 11:
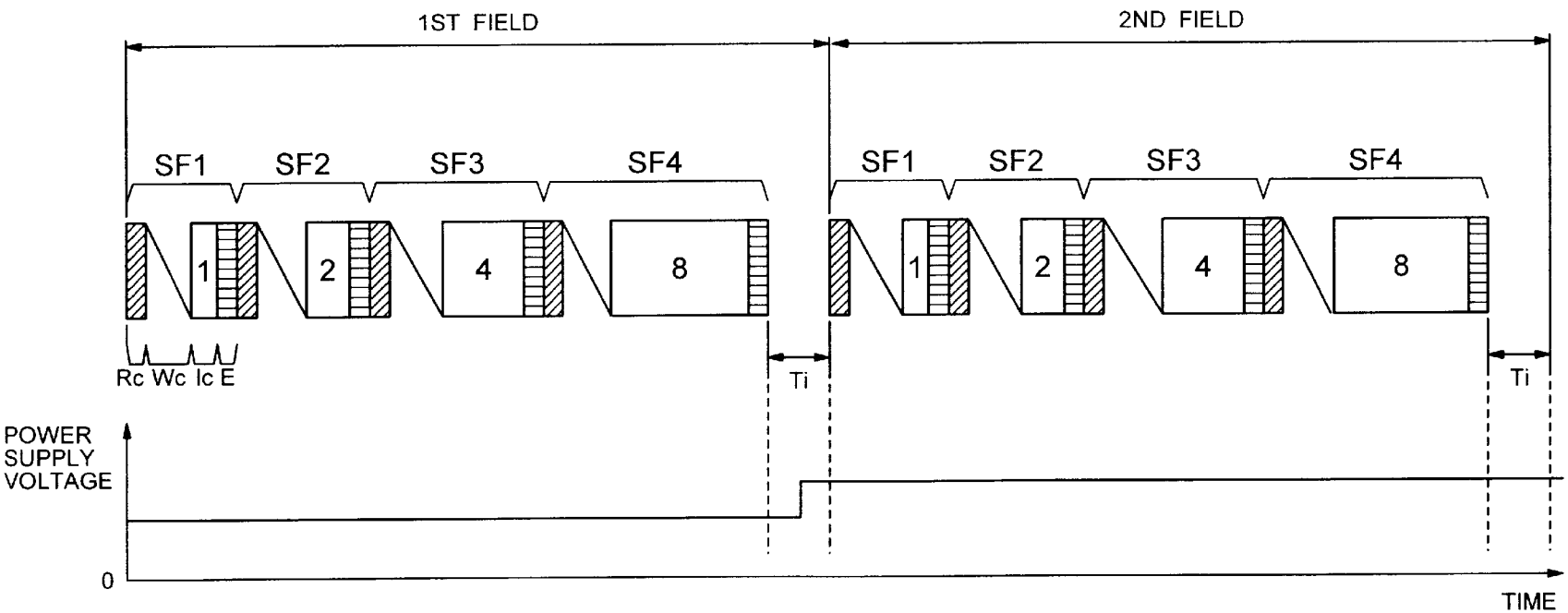
FIG. 11 shows an example of driving pulse power supply voltage switching timing.

As described above, said pulse voltage can be varied by switching the power supply voltage used in the address driver 60, the first sustain driver 70 and the second sustain driver 80. In this case, said power supply voltage switching is performed for each field, for example, as shown in FIG. 11. That is, the power supply voltage (high voltage or low voltage) to be used in the second field is determined based on the panel impedance of the PDP 10 through the first field shown in FIG. 11. Such switching is performed in a space $T_1$ at the end of the first field.

Figure 12:
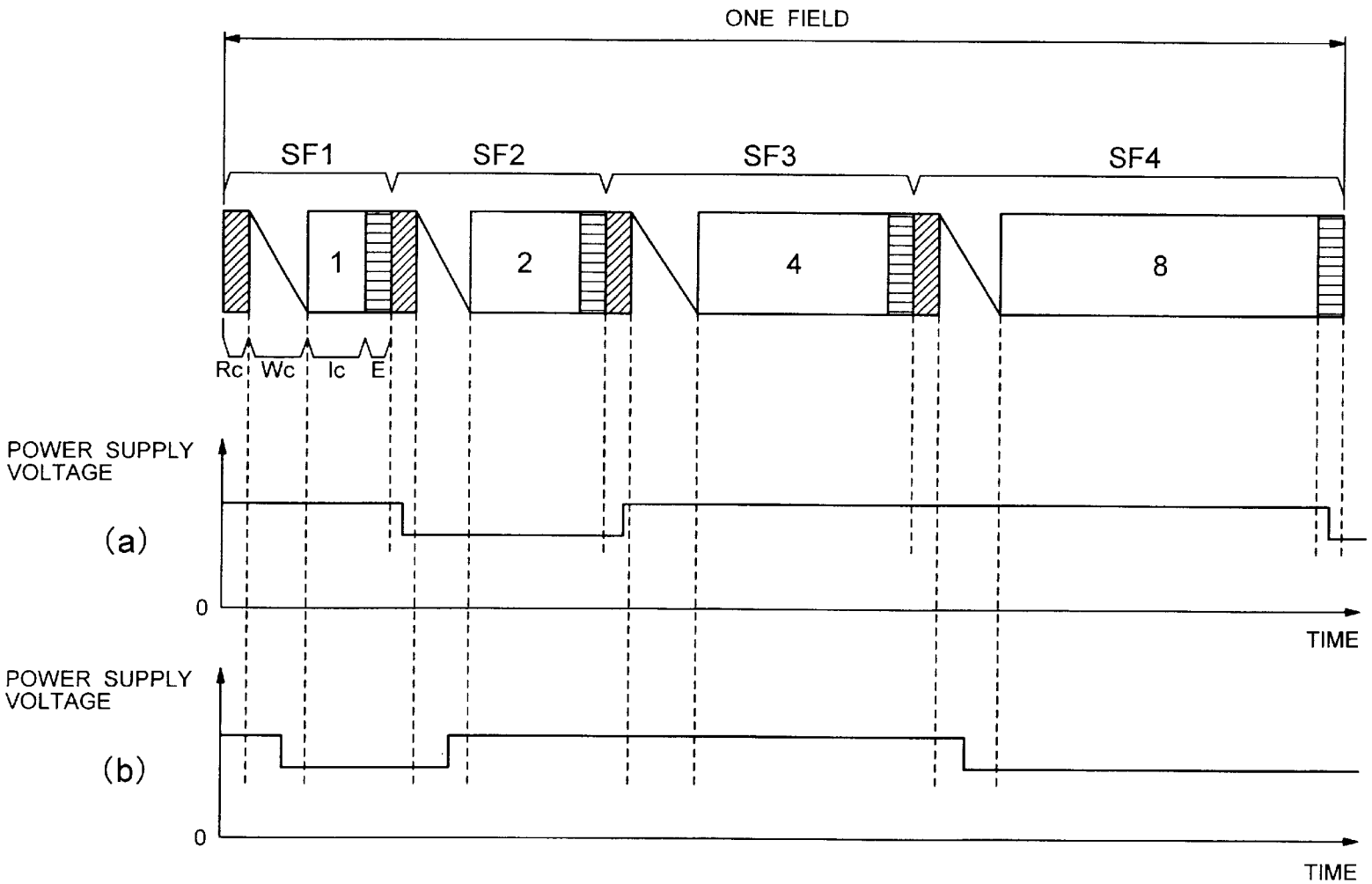
FIG. 12 shows an example of driving pulse power supply voltage switching timing.

Such power supply voltage switching may be performed for each subfield, as shown in FIG. 12. In this case, as is shown in FIG. 12, the power supply voltage (high voltage or low voltage) to be used in the subfield SF2 is determined based on the panel impedance of the PDP 10 through the subfield SF1, for example. The power supply voltage switching for changing pulse voltage Vd and Va of the picture element data pulses and the scanning pulses SP is performed during the execution period of the simultaneous reset process Rc in the subfield SF2, as shown in FIG. 12(*a*). In addition, the power supply voltage switching for changing the pulse voltage $V_s$ of the maintaining pulses $IP_X$ and $IP_Y$ is performed during the execution period of the picture element data write process Wc in the subfield SF2, as shown in FIG. 12(*b*).

As described above in detail, according to the present invention, the driving pulse width to be supplied to the plasma display panel is adjusted in accordance with the impedance of the plasma display panel. In this case, when the impedance of the plasma display panel is high, the driving pulse width is set wider than when the impedance is low. Therefore, even though the driving pulse voltage falls because of high panel impedance, and the wall charge formation speed slows down therefor, the voltage is supplied continuously by the driving pulses so that the wall charge in the discharge cell reaches the desired level during such period.

Therefore, according to the present invention, it becomes possible for any discharge cell at any location in one screen to emit light of uniform brightness, regardless of the plasma display panel's impedance, resulting in excellent tone display.

This application is based on Japanese Patent Application No. 2000-154866 which is hereby incorporated by reference.

What is claimed is:

1. A plasma display apparatus comprising a plasma display panel forming a discharge cell for a picture element at each intersection of a plurality of row electrodes carrying a display line and a plurality of column electrodes intersecting with said row electrodes; and a driver for forming one field display period of an input video signal with a plurality of subfields and driving the tone of said plasma display panel, said driver comprising:

a picture element data write driver for generating scanning pulses for causing discharge selectively for setting each of said discharge cells to a light emitting cell state or a non-light emitting cell state in response to picture element data corresponding to said input video signal, and supplying such scanning pulses to each of said row electrodes sequentially;

a light emission maintaining driver for generating maintaining pulses for causing maintenance discharge for emitting said discharge cells in said light emitting cell state only repeatedly;

an impedance estimator for obtaining estimated impedance by estimating the impedance of said plasma display panel based on said picture element data; and a pulse width controller for changing the pulse width of said scanning pulses and said maintaining pulses in accordance with said estimated impedance.

2. A plasma display apparatus according to claim 1, wherein said pulse width controller sets the pulse width of said scanning pulses and said maintaining pulses wider when said estimated impedance is high than when said impedance is low.

3. A plasma display apparatus according to claim 1, wherein said impedance estimator regards the number of said discharge cells in said light emitting cell state as said estimated impedance.

4. A plasma display apparatus according to claim 1, wherein said pulse width controller changes each pulse width of said scanning pulses and said maintaining pulses for each of said subfields.

5. A plasma display apparatus comprising a plasma display panel forming a discharge cell for a picture element at each intersection of a plurality of row electrodes carrying a display line and a plurality of column electrodes intersecting with said row electrodes; and a driver for dividing one field display period of an input video signal into a plurality of subfields and driving the tone of said plasma display panel, said driver comprising:

a picture element data write driver for generating scanning pulses for causing discharge selectively for setting each of said discharge cells to a light emitting cell state or a non-light emitting cell state in response to picture element data corresponding to said input video signal, and supplying such scanning pulses to each of said row electrodes sequentially;

a light emission maintaining driver for generating maintaining pulses for causing light maintenance discharge for emitting said discharge cells in said light emitting cell state only repeatedly and supplying the maintaining pulses to each of said row electrodes;

an impedance estimator for obtaining estimated line impedance of each of said display lines by estimating the line impedance of each of said display lines based on said picture element data; and a pulse width controller for changing the pulse width of said scanning pulses in accordance with said estimated line impedance of each of said display line and for obtaining the whole panel impedance of said plasma display panel based on said estimated line impedance of each of said display lines and for changing the pulse width of said maintaining pulses in accordance with such panel impedance.

6. A plasma display apparatus according to claim 5, wherein said pulse width controller sets the pulse width of said scanning pulses wider when said estimated line impedance is high than when said estimated line impedance is low, and sets the pulse width of said maintaining pulses wider when said panel impedance is high than when said panel impedance is low.

7. A plasma display apparatus according to claim 5, wherein said impedance estimator regards the number of said discharge cells in said light emitting cell state on one display line as said estimated line impedance.

8. A plasma display apparatus according to claim 5, wherein said pulse width controller changes each pulse width of said scanning pulses and said maintaining pulses for each of said subfields.

9. A plasma display apparatus comprising a plasma display panel forming a discharge cell for a picture element at each intersection of a plurality of row electrodes carrying a display line and a plurality of column electrodes intersecting with said row electrodes; and a driver for forming one field display period of an input video signal with a plurality of subfields and driving the tone of said plasma display panel, said driver comprising:

a picture element data write driver for generating scanning pulses for causing discharge selectively for setting each of said discharge cells to a light emitting cell state or a non-light emitting cell state in response to picture element data corresponding to said input video signal, and supplying such scanning pulses to each of said row electrodes sequentially;

a light emission maintaining driver for generating maintaining pulses for causing maintenance discharge for emitting said discharge cells in said light emitting cell state only repeatedly and supplying the maintaining pulses to each of said row electrodes;

an impedance estimator for obtaining estimated impedance by estimating the impedance of said plasma display panel based on said picture element data; and a pulse voltage controller for changing the pulse voltage of each of said scanning pulses and said maintaining pulses in accordance with said estimated impedance.

10. A plasma display apparatus according to claim 9, wherein said pulse voltage controller sets each pulse voltage of said scanning pulses and said maintaining pulses higher when said estimated impedance is high than when said estimated impedance is low.

11. A plasma display apparatus according to claim 9, wherein said impedance estimator regards the number of said discharge cells in said light emitting cell state as said estimated impedance.

12. A plasma display apparatus according to claim 9, wherein said pulse voltage controller changes each pulse voltage of said scanning pulses and said maintaining pulses for said one field display period or said one subfield.

* * * * *